166-308
8/4/87 XR 4,683,950 SR

United States Patent [19]

Lessi

[11] Patent Number: 4,683,950

[45] Date of Patent: Aug. 4, 1987

[54] PROCESS FOR HYDRAULICALLY FRACTURING A GEOLOGICAL FORMATION ALONG A PREDETERMINED DIRECTION

[75] Inventor: Jacques Lessi, Maisons Laffitte, France

[73] Assignee: Institut Francais Du Petrole, Rueil-Malmaison, France

[21] Appl. No.: 266,039

[22] Filed: May 22, 1981

[30] Foreign Application Priority Data

May 23, 1980 [FR] France ..... 80 11648

[51] Int. Cl.[4] ..... E21B 43/26

[52] U.S. Cl. ..... 166/271; 166/308

[58] Field of Search ..... 166/308, 309, 271, 259; 299/4, 5

[56] References Cited

U.S. PATENT DOCUMENTS

| | | | |
|---|---|---|---|
| 2,758,653 | 8/1956 | Desbrow | 166/308 |
| 2,850,270 | 9/1958 | Hanson | 299/4 |
| 2,859,819 | 11/1958 | Trolt | 166/308 |
| 3,329,207 | 7/1967 | Shock et al. | 166/308 |
| 3,370,887 | 2/1968 | Knutson et al. | 299/4 |
| 3,709,295 | 1/1975 | Braunlich, Jr. | 166/271 |
| 3,850,477 | 11/1970 | Aldrich et al. | 299/5 |
| 3,967,853 | 7/1976 | Closmann et al. | 299/5 |
| 3,990,514 | 11/1976 | Kreinin et al. | 166/271 |

*Primary Examiner*—James A. Leppink
*Assistant Examiner*—Hoang C. Dang
*Attorney, Agent, or Firm*—Millen & White

[57] ABSTRACT

This process comprises positioning along a predetermined direction two walls penetrating a geological formation to be fractured. During a preliminary period a predetermined amount of hydraulic fluid in injected.

During a preliminary period/hydraulic fluid is injected simultaneously into both wells during for a sufficient time interval at a pressure insufficient to fracture the formation, either at a substantially constant flow rate, or in a stepwise manner at progressively increasing pressure levels. This preliminary injection is followed by the injection of hydraulic fluid into at least one of the wells at a pressure higher than the pressure of fractuation of the formation.

13 Claims, 2 Drawing Figures

PROCESS FOR HYDRAULICALLY FRACTURING A GEOLOGICAL FORMATION ALONG A PREDETERMINED DIRECTION

BACKGROUND OF THE INVENTION

The present invention relates to a process for hydraulically fracturing a geological formation along a predetermined direction.

Fracturing of a geological formation is sometimes employed to establish communication between two wells at the level of the geological formation. This communication is, for example, established to achieve underground gasification of a coal bed whose permeability is insufficient to ensure the gas flow rate required between the two wells to sustain backward burning. Fracturing of geological formations is also employed in the field of enhanced hydrocarbon recovery processes wherein a pressurized fluid is injected from injected wells into the geological formation to cause hydrocarbon transfer toward production wells. As a matter of fact, it may be desirable in this case to improve fluid injection or hydrocarbon recovery by fracturing the geological formation along a direction which is preferably perpendicular to the direction of flow of the fluid.

This fracturation, which can establish a communication on the one hand between the injection wells and/or, on the other hand, the production wells, thus improves the scavenging of the geological formation by the injected fluid.

It is already known to fracture a geological formation traversed by a well by injecting a hydraulic fluid at a sufficient pressure at the level of the geological formation. The direction of the so-created fracture mainly depends on the field or tensor of the pre-existing stresses in the geological formation. In the most favourable cases this direction is known more or less with accuracy. The wells to be connected by fracturing are then positioned along this direction.

In spite of this, experience shows that the so-achieved fracturation does not always correspond to the desired one and, for example, cannot interconnect two wells whose locations are remote from each other.

U.S. Pat. No. 3,270,816 describes a method for fracturing a soluble geological formation so as to interconnect the two wells. According to this method a notch is created in the wall of each well so that the fracture develops from these notches when pressure is established in the wells. These notches are postitioned so that the cracks developed from each well are at an angle with the plane containing the axes of the two wells, so that two secant cracks are created. Experience has shown that this method is not suitable for insoluble geologic formations.

Other methods have been described to create networks of cracks perpendicular to each other so as to establish communication between several wells.

One of these methods is described in U.S. Pat. No. 3,682,246 which teaches conducting two successive pressurizing steps in one and the same well for fracturing the formation along two perpendicular directions. Experience has shown that this double fracturing of one and the same well cannot be effected in practice.

Another method, described in U.S. Pat. No. 3,709,295, makes use of three wells aligned along the natural direction of fracturing. The two lateral wells are hydraulically fractured, then the central well is hydraulically fractured while the lateral wells are kept under pressure. This is supposed to induce a crack at right angles to the preceding fractures. Experience and calculations have shown that injection of hydrualic fluid into the fractures induced from the lateral wells leads to a modification in the stress field in the vicinity of the central well by rendering this field isotropic. As a consequence, the direction of fracturing at the location of the central well cannot be ascertained.

According to a third method, described in U.S. Pat. No. 4,005,750, it is possible to create a network of cracks intersecting one another so as to interconnect a plurality of wells.

To this end, a first well is fractured along its natural direction of fracturing, then, while keeping the pressure at the same level in the first well so as to maintain the fractures open, a second well is fractured so as to induce therefrom second cracks which intersect the first fracture. The operating steps are then repeated starting from the second well and there is thus obtained in a step by step manner a network of mutually perpendicular cracks.

Thus, none of these prior techniques provides a fracturing along a single predetermined direction which may differ from the natural direction of fracturation.

SUMMARY OF THE INVENTION

Diagrammatically, the method according to the invention provides a change in the field or tensor of stresses within the geological formation prior to fracturing thereof, so that this fracturing occurs substantially along a predetermined direction.

More particularly, the method according to the invention for hydraulically fracturing a geological formation along a determined direction employs at least two injection wells which intersect the geological formation and are positioned along the predetermined direction. There is then simultaneously effected in both wells at the level of the formation, during a time interval at least equal to a preselected minimum value, a preliminary injection of a predetermined amount of hydraulic fluid whose pressure at the end of this preliminary injection is lower than the pressure required to fracture the geological formations. Then, this preliminary injection period is followed with an injection of hydraulic fluid into at least one of the two injection wells at a pressure at least equal to the pressure of fracturation of the geological formation.

The preliminary injection may be effected at a substantially constant flow rate, or at a substantially constant pressure.

DETAILED DISCUSSION OF THE INVENTION

The invention will become readily understood and its advantages made apparent from the following description illustrated by the accompanying drawings, wherein.

DETAILED DISCUSSION OF THE INVENTION

Figure 1:
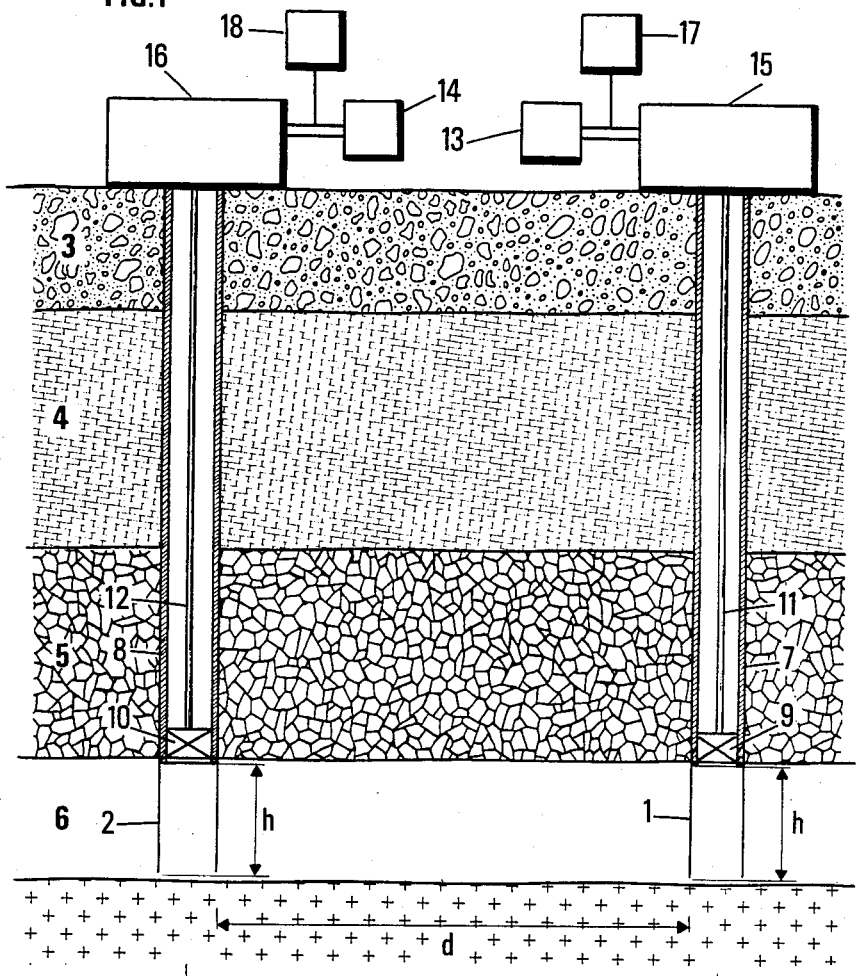
FIG. 1 shows two wells which are to be connected by hydraulic fracturation.

In the following description reference will be made more particularly, but non limitatively, to the application of the method according to the invention for fracturing a geological formation along a predetermined direction and for establishing a direct communication between two wells penetrating this formation, the axes of these wells being contained in a plane oriented along the predetermined direction.

References 1 and 2 designate two wells drilled through the ground layers 3, 4, and 5, and penetrating the geological formation 6 at the level of which communication must be established between these two wells through fractures oriented along a predetermined direction. In each well a casing 7 and 8 is positioned in a manner known per se and effects the sealing of the borehole wall at the level of the ground layers 3, 4 and 5, i.e. leaving the well uncased over a height h at its lower end, at the level of the geological formation 6.

Packer means 9 and 10 for obturating the casings are secured at the lower end of each casing 7 and 8. Pipes 11 and 12 traverse the obturating means, to permit injection of a pressurized hydraulic fluid at the lower part of the wells 1 and 2, at the level of the geological formation 6.

This hydraulic fluid is supplied from pumps 13 and 14 connected with the surface apparatuses 15 and 16 equipping the wells 1 and 2.

The method according to the invention comprises at least two successive steps including a preliminary step prior to fracturation, then the fracturing step itself which may optionally be accompanied by an operation adapted to keep the fracture open.

The preliminary step before the fracturation step comprises injecting during a time interval $T_i$ at least equal to a preselected value, a quantity $M_i$ of hydraulic fluid, in both wells 1 and 2 simultaneously under flow conditions which may be identical. This injection may be performed in two ways :

(a) injection at a constant, or substantially constant flow rate. Hydraulic fluid is injected at a substantially constant flow rate $Q_i$ during the injection time $T_i$. The values $Q_i$ and $T_i$ are selected so that, at the end of this injection step, the pressure of the hydraulic fluid at the level of the geological formation 6 remains lower than the fracturation pressure $P_f$ of this formation. According to the invention, the duration $T_i$ of this injection is defined by the relationship $$K\,T_i = n\,d^2$$

where n is an arbitrary coefficient of a value comprised between 0.25 and 2.5, d (measured in meters) is the distance between the two wells, and K (in $m^2$/second) is the diffusion coefficient of the geological formation, as defined by the formula $$\phi\mu c K = k$$

where $\phi$ is the porosity and c the compressibility of the fluid-impregnated geological formation, $\mu$ is the viscosity of the hydraulic fluid, and k the permeability coefficient of the formation 6. Under these conditions the injection flow rate $Q_i$ is selected so that $$\mu Q_i E_i\left[\frac{-a^2}{4KT_i}\right] = 4\pi hk(P_f - P_o),$$

where h is the height of the well above which hydraulic fluid is injected into the geological formation 6, $P_f$ is the fracturation pressure of this formation and $P_o$ is the initial static pressure at the level of the geological formation 6, "a" being the radius of each well, and $$E_i\left[\frac{-a^2}{4KT_i}\right]$$

is the integral exponential function defined by the relationship $$E_i\left[\frac{-a^2}{4KT_i}\right] = \int_{\frac{a^2}{4KT_i}}^{\infty} \frac{e^{-u}}{u}\,du$$

The value of the fracturation pressure $P_f$ may be derived from a preceding fracturation test or calculated by using the formula $$(1+\nu)\,P_f = (1+\nu)\,P_o + R_t - 2\sigma,$$

$\nu$ being the Poisson ratio, $\sigma$ the minimum initial effective stress in the geological formation, and $R_t$ the tensile strength of the geological formation 6; or (b) injection under constant pressure. Injection is simultaneously effected in both wells under a substantially constant pressure P over a time interval $T'_i$. The value P of the pressure is selected slightly lower than the value $P_f$, and the injection period $T'_i$ is sufficient so that at the end thereof the fluid flow rate is stabilized, i.e. substantially constant. In practice the value of the fracturation pressure $P_f$ need not be known with high accuracy. The injection of hydraulic fluid is effected by gradations, or stepwise with at least one pressure level or step corresponding to a pressure value P lower than the estimated value of $P_f$, the selected injection period $T'_{i1}$ being sufficient to reach steady fluid flow conditions at the end of this preliminary injection step. Optionally other injection steps under constant pressure $P+\Delta P_1$, $P+\Delta P_2$ . . . , all lower than $P_f$, are carried out over respective periods $T'_{i2}$, $T'_{i3}$. . . The number of pressure steps or levels will generally be as reduced as possible, the injection period corresponding to each pressure level being of the order of $$(d^2/4\,K)$$

The above described preliminary period step is followed with a fracturation period from at least one of the wells, this fracturation being carried out by using pumping means adapted to deliver a high flow rate of hydraulic fluid under a pressure at least equal to the fracturation pressure $P_f$ of the formation. The development of the fracturation may be followed with the help of measuring means diagrammatically shown at 17 and 18 which indicate the pressure and flow rate of the fluid injected into each well.

This fracturation step may optionally be followed with an additional operation adapted to keep the fracture open, for example, but not limitatively, by injecting propping agents which keep the cracks open. Such a consolidation step is well known in the art and needs not to be described here in more detail.

According to an alternative embodiment of this process, at least one lateral well penetrating the geological formation 6 is associated with at least one of the two wells 1 and 2 wherein fracturation is induced. This lateral well is so positioned that the plane containing the axis of this lateral well and the axis of the well to which it is associated is perpendicular to the plane passing through the axes of the two wells 1 and 2 between which fracturation is effected.

Figure 2:
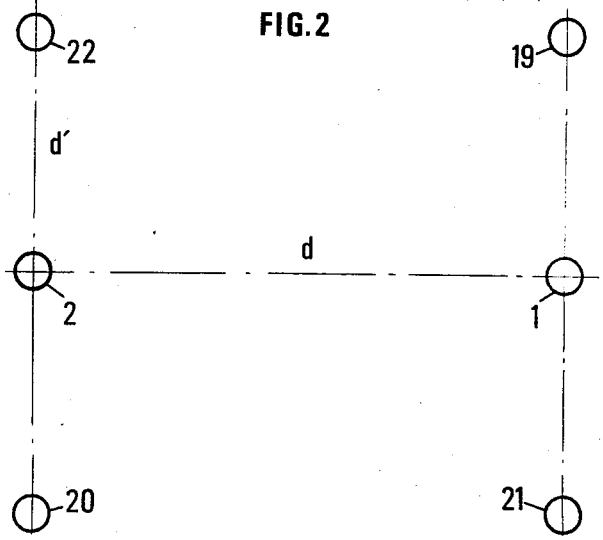
FIG. 2 illustrates an alternative embodiment of the process according to the invention employing two lateral production wells.

As shown in FIG. 2 a pair of lateral wells 19–21 and 20 ∝ 22 is preferably associated with each of the wells 1 and 2, the wells of each pair being symmetrically located relative to each other, with respect to the well with which these lateral wells are associated.

The lateral wells are then brought into production during at least a part of the preliminary period of hydraulic fluid injection into the injection wells 1 and 2.

Production of these lateral wells may occur naturally when the pressure of the fluid produced through these wells is sufficient ; however, this production may optionally be obtained with the help of a pumping equipment placed at the bottom of the lateral wells.

The above described method according to the invention thus makes it possible to orient the azimuth of the vertically developing cracks or fractures, or to favor a particular direction of propagation of the cracks which develop horizontally.

Obviously the wells 1 and 2 will be positioned, whenever possible, along a direction as close as possible to the natural direction of hydraulic fracturation which would be obtained by injecting into a single well a hydraulic fluid at a pressure higher than the fracturation pressure, or along the direction of highest permeability of the geological formation.

In the above description the preliminary injection of hydraulic fluid into both injection wells is effected under substantially the same flow conditions.

However, it will be possible to realize the preliminary injection of hydraulic fluid into the two injection wells under different flow conditions. For instance, it is possible to inject the hydraulic fluid into one of the wells under a constant or substantially constant flow rate while injecting the hydraulic fluid under substantially constant pressure into the other well.

What is claimed is :

1. A process for hydraulically fracturing a geological formation along a predetermined direction, comprising:

injecting a pressurized fluid into at least two injection wells penetrating the formation, with said two wells positioned along said predetermined direction, and with said injecting step comprising effecting a preliminary injection of a predetermined quantity of hydraulic fluid in both wells simultaneously at the level of the geological formation, during a time interval at least equal to a preselected minimum value, with the pressure of the hydraulic fluid at the level of the formation at the end of this preliminary injection period remaining lower than the pressure of fracturation of the geological formation, and said preliminary injection being conducted to directly cause by diffusion of the fluid a sufficient change in the field or tensor of stresses within the geological formation at a distance remote from each of said wells, to define said predetermined direction of fracture; and following the preliminary injection with an injection of hydraulic fluid through at least one of said wells at a pressure at least equal to the pressure of fracturation of the geological formation to cause fracturing thereof along said predetermined direction.

2. A process according to claim 1, wherein the preliminary injection of hydraulic fluid into each of the two injection wells is effected under substantially the same flow conditions.

3. A process according to claim 1, wherein the preliminary injection of hydraulic fluid into at least one of the injection wells is effected at a substantially constant flow rate $Q_i$ over a time interval $T_i$ such that:

$$K\,T_i = n\,d^2$$

and $$Q_i \mu E_i \left[ \frac{-a^2}{4KT_i} \right] = 4\pi hk(P_f - P_o),$$

wherein n is an arbitrary coefficient having a value comprised between 0.25 and 2.5, d is the distance between the two injection wells, K is the diffusion coefficient of the geological formation, k is the permeability coefficient of the geological formation, $P_f$ is the fracturation pressure of the geological formation, $P_o$ is the initial static pressure in the formation, $\mu$ is the viscosity of the hydraulic fluid, a is the radius of the injection wells, and $E_i$ is the integral exponential function.

4. A process according to claim 1, wherein the preliminary injection of hydraulic fluid is effected into at least one of the injection wells under substatially constant pressure by creating at least a pressure level of a lower value than the fracturation pressure of the geological formation over a sufficient time interval as to reach, under the considered pressure, steady fluid flow conditions wherein the injection flow rate tends to become stable.

5. A process according to claim 4, wherein the preliminary injection is effected under a substantially constant pressure by applying successive pressure levels of increasing pressure values approaching the fracturation pressure of the geological formation.

6. A process according to claim 1, wherein at least one laterally located production well is associated with at least one injection well, said associated lateral production well penetrating the geological formation so as to be in hydraulic communication therewith, and being positioned so that the plane passing through the axis of this lateral well and the axis of the injection well with which this lateral well is associated is perpendicular to the plane passing through the axis of the injection wells, and the process further comprising bringing said lateral well into production during at least a part of said preliminary injection period.

7. A process according to claim 6, wherein a pair of production wells is associated with each injection well, the wells of each pair being symmetrically located with respect to the injection well with which they are associated.

8. A process according to claim 1, wherein the injection wells are positioned substantially along the natural direction of hydraulic fracturation.

9. A process according to claim 1, wherein the injection wells are positioned substantially along the direction of highest permeability of the geological formation.

10. A process for fracturing a geological formation, along a predetermined direction, by making use of two injection wells penetrating the formation and positioned along said predetermined direction, the process comprising preparing for the fracturation by effecting a preliminary injection of a predetermined quantity of fluid in both wells simultaneously at the level of the geological formation, during a time interval at least equal to a preselected minimum value, and said preliminary injection being conducted to cause by diffusion of the fluid a sufficient change in the field or tensor of stresses within the geological formation at a distance remote from each of said wells to define said predetermined direction of fracture, with the pressure of the fluid at the level of the formation at the end of this preliminary injection period remaining lower than the pressure of fracturation of the geological formation, and following said preliminary injection with the step of fracturing the geological formation.

11. A process for fracturing a geological formation, along a predetermined direction, comprising injecting a pressurized fluid into at least two injection wells penetrating the formation, wherein said two wells are positioned along said predetermined direction, and said injecting of a pressurized fluid comprising:

effecting a preliminary injection of a predetermined quantity of fluid in both wells simultaneously at the level of the geological formation, during a time interval at least equal to a preselected minimum value, and said preliminary injection being conducted to cause by diffusion of the fluid a sufficient change in the field or tensor of stresses within the geological formation at a distance remote from each of said wells to define said predetermined direction of fracture, with the pressure of the fluid at the level of the formation at the end of this preliminary injection period remaining lower than the pressure of fracturation of the geological formation, and following the preliminary injection with an injection of fluid through at least one of said wells at a pressure at least equal to the pressure of fracturation of the geological formation.

12. A process according to claim 10, wherein the preliminary injection of fluid into each of the two injection wells is effected under substantially the same flow conditions.

13. A process according to claim 11, wherein the preliminary injection of fluid into each of the two injection wells is effected under substantially the same flow conditions.

* * * * *